US010796523B2

(12) United States Patent
Eby et al.

(10) Patent No.: US 10,796,523 B2
(45) Date of Patent: Oct. 6, 2020

(54) GAMING DEVICE, ELECTRONIC DEVICE INTERFACE SUPPORTED BY A GAMING DEVICE AND METHODOLOGIES FOR UTILIZING THE SAME

(71) Applicant: Greektown Casino LLC, Detroit, MI (US)

(72) Inventors: Brian Eby, Birmingham, MI (US); Hugh Flack, Troy, MI (US); Anthony Williams, Sterling Heights, MI (US); Adam Suliman, Grosse Pointe Woods, MI (US)

(73) Assignee: Perfected Player Solutions LLC, Detroit, MI (US)

( * ) Notice: Subject to any disclaimer, the term of this patent is extended or adjusted under 35 U.S.C. 154(b) by 1038 days.

(21) Appl. No.: 14/873,662

(22) Filed: Oct. 2, 2015

(65) Prior Publication Data

US 2016/0098892 A1 Apr. 7, 2016

Related U.S. Application Data

(60) Provisional application No. 62/059,029, filed on Oct. 2, 2014.

(51) Int. Cl.
*G07F 17/32* (2006.01)

(52) U.S. Cl.
CPC ..... *G07F 17/3216* (2013.01); *G07F 17/3204* (2013.01); *G07F 17/3223* (2013.01); *G07F 17/3241* (2013.01)

(58) Field of Classification Search
CPC ..... G07F 17/3216; G07F 17/3204; G07F 17/3241; G07F 17/3223
See application file for complete search history.

(56) References Cited

U.S. PATENT DOCUMENTS

2003/0127512 A1* 7/2003 Boyd ..... G06Q 20/04 235/380
2008/0076570 A1* 3/2008 Johnson ..... G07F 17/32 463/42
2011/0269532 A1* 11/2011 Shuster ..... G07F 17/3274 463/25

* cited by examiner

*Primary Examiner* — Kang Hu
*Assistant Examiner* — Thomas H Henry
(74) *Attorney, Agent, or Firm* — Honigman LLP

(57) ABSTRACT

An apparatus is disclosed. The apparatus includes a gaming device and an electronic device interface. The gaming device includes a housing having an least one outer surface. The electronic device interface is removably-secured to the at least one outer surface of the housing. The electronic device interface includes connection hardware directly connected to an external power source. The connection hardware is fixedly-disposed within a cavity of an electronic device port of the electronic device interface.

3 Claims, 10 Drawing Sheets

GAMING DEVICE, ELECTRONIC DEVICE INTERFACE SUPPORTED BY A GAMING DEVICE AND METHODOLOGIES FOR UTILIZING THE SAME

CROSS-REFERENCE TO RELATED APPLICATIONS

This U.S. patent application claims priority to U.S. Provisional Application 62/059,029 filed on Oct. 2, 2014 the disclosure of which is considered part of the disclosure of this application and is hereby incorporated by reference in its entirety.

TECHNICAL FIELD

The disclosure relates to a gaming device, an electronic device interface supported by a gaming device, and methodologies for utilizing the same.

BACKGROUND

Gaming devices are known in the art. Some gaming devices permit one or more credits to be wagered on the possibility of a combination of a plurality of characters (e.g., numbers, letters, graphics or symbols) aligning upon one or more pay-lines.

While known gaming devices have proven to be acceptable for various applications, such conventional gaming devices are nevertheless susceptible to improvements that may enhance their overall performance and gaming experience offered to a patron. Therefore, a need exists to develop improved gaming devices that advance the art.

DESCRIPTION OF THE DRAWINGS

The disclosure will now be described, by way of example, with reference to the accompanying drawings, in which.

SUMMARY

Figure 1:
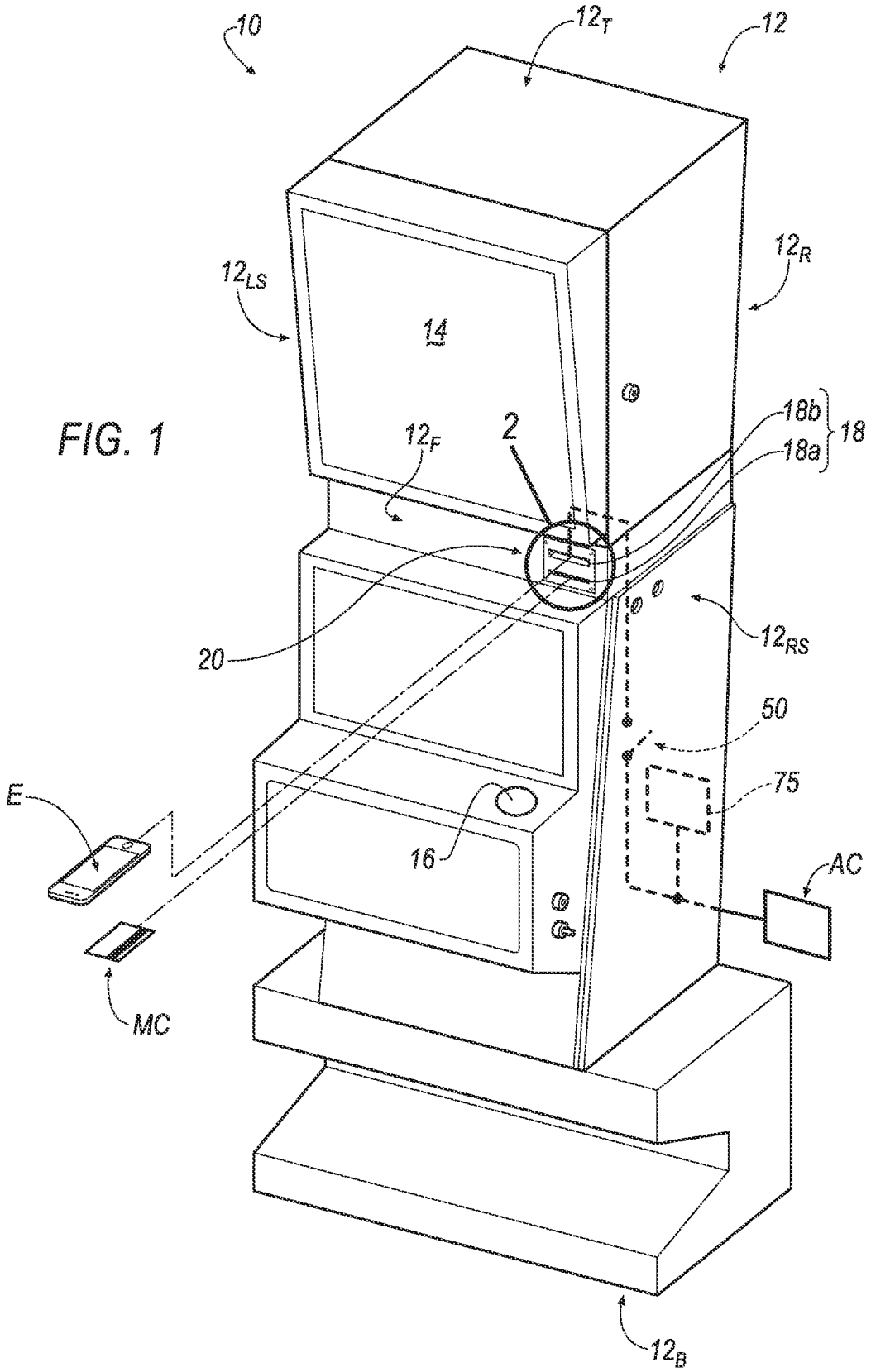
FIG. 1 is a perspective view of an exemplary gaming device.

One aspect of the disclosure provides an apparatus. The apparatus includes a gaming device and an electronic device interface. The gaming device includes a housing having an least one outer surface. The electronic device interface is removably-secured to the at least one outer surface of the housing. The electronic device interface includes connection hardware directly connected to the external power source. The connection hardware is fixedly-disposed within a cavity of an electronic device port of the electronic device interface.

In some examples, the electronic device interface includes a faceplate that forms one or more fastener passages. One or more fasteners are removably-disposed within the one or more fastener passages for removably-securing the faceplate to the at least one outer surface of the housing.

In some implementations, the at least one outer surface of the housing at least partially defines an electronic device receiving cavity that extends into the housing.

In some instances, the electronic device receiving cavity is defined by a length dimension, a height dimension, and a depth dimension.

In some examples, at least two of the length dimension, the height dimension and the depth dimension are approximately equal to but slightly greater than a length dimension, a height dimension and a depth dimension of an electronic device to be removably-disposed within the electronic device receiving cavity.

In some implementations, the apparatus includes a computing resource and a switch.

In some instances, the computing resource is disposed within the housing. The switch is disposed within the housing and communicatively-coupled to the computing resource. The switch is arrangeable in a closed orientation to permit the connection hardware to be connected to the external power source. The switch is arrangeable in an open orientation to permit the connection hardware to be disconnected from the external power source.

In some examples, the computing resource does not contain logic or processing associated with operation of a game of chance provided by the gaming device.

In some implementations, the at least one outer surface of the housing at least partially forms at least one slot.

In some instances, a slot of the at least one slot is sized for receiving an identification card.

In some examples, a slot of the at least one slot is sized for receiving an electronic device. The electronic device receiving cavity is defined by a length dimension, a height dimension, and a depth dimension. At least two of the length dimension, the height dimension and the depth dimension are approximately equal to but slightly greater than a length dimension, a height dimension and a depth dimension of an electronic device to be removably-disposed within the electronic device receiving cavity.

In some implementations, the electronic device receiving cavity extends substantially perpendicularly into the at least one outer surface of the housing such that the electronic device is arrangeable in a cantilevered orientation relative to the housing when the electronic device is disposed within the electronic device receiving cavity and connected to the connection hardware.

In some instances, the electronic device interface includes a faceplate defining a cantilevered portion that extends outwardly and away from the front surface portion of the housing forming a docking tray that supportably-receives the electronic device in a substantially upright orientation when the electronic device is disposed within the electronic device receiving cavity and connected to the connection hardware.

Another aspect of the disclosure provides a method including the steps of: inserting an end of an electronic device into an electronic device port; hardwire-connecting the electronic device to connection hardware; without a prerequisite, permitting the electronic device to receive power from a power source; and providing power from the power source to the electronic device.

In some examples, the method includes automatically aligning a port of the electronic device with connection hardware disposed within the electronic device port.

In some implementations, the method includes manually aligning a port of the electronic device with connection hardware disposed within the electronic device port.

In yet another aspect of the disclosure provides a method including the steps of: inserting an end of an electronic device into an electronic device port; hardwire-connecting the electronic device to connection hardware; determining if the electronic device should be granted access to a power source; upon determining that the electronic device should be granted access to the power source, permitting the electronic device to receive power from the power source; and providing power from the power source to the electronic device.

In some examples, the method includes automatically aligning a port of the electronic device with connection hardware disposed within the electronic device port.

In some implementations, the method includes manually aligning a port of the electronic device with connection hardware disposed within the electronic device port.

In some instances, the method includes determining that an identification card is removably-interfaced with a slot.

In some examples, the method includes determining that a patron of the gaming device has logged a predetermined amount of play time with the gaming device.

In some implementations, the method includes determining that a patron of the gaming device has met or exceeded a predetermined amount of play time with the gaming device.

In some instances, the method includes determining that a patron of the gaming device has wagered or lost a predetermined amount of money with the gaming device.

In some examples, the method includes determining that a patron of the gaming device has activated an app or software that is running on the electronic device.

Yet another aspect of the disclosure provides a method including the steps of: _.

In some examples, the method includes powering-on an electronic device; activating a send/receive antenna of the electronic device; broadcasting an electronic device search signal from an antenna connected to a gaming device; locating the electronic device being proximate to the gaming device; wirelessly connecting the electronic device to the gaming device; and wirelessly retrieving patron identification information from the electronic device.

In some implementations, the method includes after the locating step and before the wirelessly connecting step, presenting an offer to wirelessly connect the electronic device to the gaming device.

In some instances, the method includes after the presenting step and before the wirelessly connecting step manually authorizing wireless connection of the electronic device to the gaming device.

In some examples, the method includes after the presenting step and before the wirelessly connecting step automatically authorizing wireless connection of the electronic device to the gaming device.

DETAILED DESCRIPTION

The figures illustrate an exemplary implementation of a gaming device, an electronic device interface supported by a gaming device, and methodologies for utilizing the same. Based on the foregoing, it is to be generally understood that the nomenclature used herein is simply for convenience and the terms used to describe the invention should be given the broadest meaning by one of ordinary skill in the art.

FIG. 1 illustrates an exemplary implementation of a gaming device, which is shown generally at 10. The gaming device 10 includes a housing 12 that contains electronics and/or mechanical components that compose a game of chance (noting that the electronics associated with the game of chance is not a computing resource 75, which will be described in greater detail in the following disclosure). The housing 12 may be defined by a plurality of side surface portions such as, for example: a front surface portion $\mathbf{12}_F$, a rear surface portion $\mathbf{12}_R$, a top surface portion $\mathbf{12}_T$, a bottom surface portion $\mathbf{12}_B$, a left side surface portion $\mathbf{12}_{LS}$ and a right side surface portion $\mathbf{12}_{RS}$.

An external power source, AC (e.g., alternating current power), is shown connected to, for example, a computing resource 75 that is disposed within the housing 12 of the gaming device 10. The computing resource 75 does not contain logic or processing associated with the operation of a game of chance; rather, the computing resource 75 may detect, for example, if one or more of a magnetic strip card, MC, and an electronic device, E, is removably-interfaced with the housing 12. The computing resource 75 may be, for example, a digital computer, and may include, but is not limited to: one or more electronic digital processors or central processing units (CPUs) in communication with one or more storage resources (e.g., memory, flash memory, dynamic random access memory (DRAM), phase change memory (PCM), and/or disk drives having spindles)).

In some implementations, the front surface portion $\mathbf{12}_F$ of the housing 12 may support a video monitor 14 that displays features (e.g., a plurality of characters and one or more pay-lines) of the game of chance and an actuator 16 that permits authorization of one or more credits to be spent in exchange for at least one play of the game of chance. The front surface portion $\mathbf{12}_F$ of the housing 12 may also define one or more slots 18.

A slot 18*a* of the one or more slots 18 permits, for example, the magnetic strip card, MC, to be removably-interfaced with the slot 18*a*. In some instances, the magnetic strip card, MC, may include identification information related to the patron of the gaming device 10 in order to document and reward the patron in exchange for, for example: (1) a predetermined number or plays on the gaming device 10, (2) an amount of wagers by the patron, (3) winnings awarded to the patron, (4) losses incurred by the patron or the like.

A slot 18*b* of the one or more slots 18 permits, for example, the electronic device, E, to be removably-interfaced with the slot 18*b*. In some instances, the electronic device, E, may provide a function substantially similar to that as the memory card, MC, as described above and include, for example, identification information related to the patron of the gaming device 10 in order to document and reward the patron in exchange for, for example: (1) a predetermined number or plays on the gaming device 10, (2) an amount of wagers by the patron, (3) winnings awarded to the patron, (4) losses incurred by the patron or the like.

Figure 2:
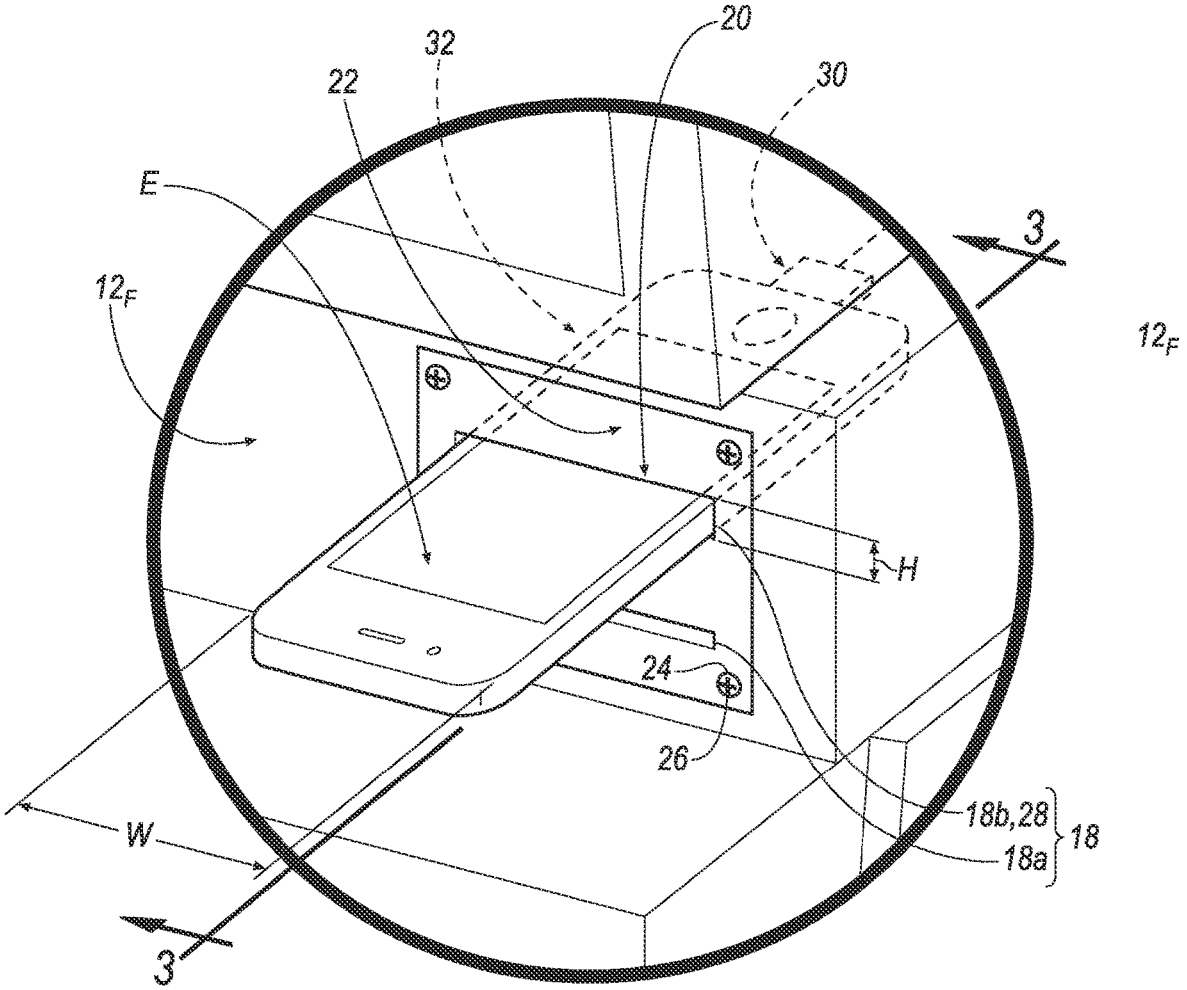
FIG. 2 is an enlarged view of the gaming device of FIG. 1 according to line 2.

Referring to FIGS. 1, 2 and 3A-3B, the front surface portion $\mathbf{12}_F$ of the housing 12 may also include an electronic device interface 20. As seen in FIG. 2, the electronic device interface 20 may include, for example, a faceplate 22 that forms one or more fastener passages 24 and at least the slot 18*b* of the one or more slots 18. The electronic device interface 20 may also include one or more fasteners 26 that are disposed within the one or more fastener passages 24 for removably-securing the faceplate 22 to the front surface portion $\mathbf{12}_F$ of the housing 12.

Figure 3A:
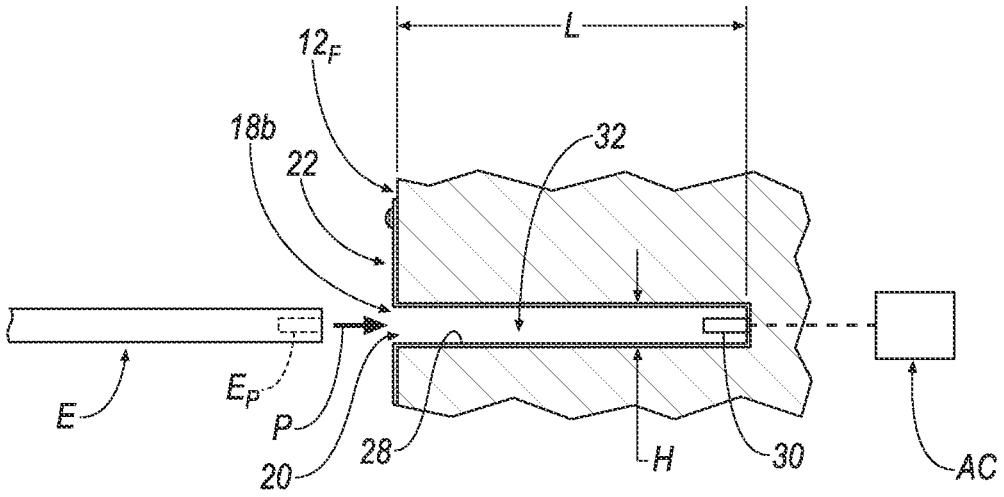
FIG. 3A is a cross-sectional view according to line 3-3 of FIG. 2 illustrating an electronic device in a first orientation relative to the gaming device.
Figure 3B:
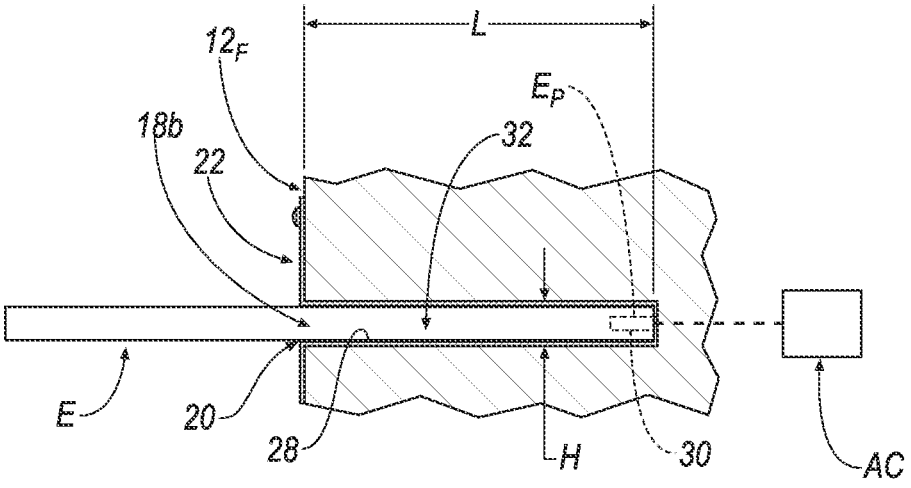
FIG. 3B is a cross-sectional view according to line 3-3 of FIG. 2 illustrating an electronic device in a second orientation relative to the gaming device.

The slot 18*b* formed by the faceplate 22 may provide access to an electronic device port 28 that includes connection hardware 30. As seen in FIGS. 3A-3B, the connection hardware 30 is directly connected to the external power source, AC.

The connection hardware 30 may include any desirable structural configuration. Further, if desired, the one or more fasteners 26 may be removed in order to permit the faceplate 22 to be removed from the front surface portion $\mathbf{12}_F$ of the housing 12 in order to, for example, replace or upgrade the connection hardware 30, if, for example, the connection hardware 30 needs to be serviced, or, for example, is obsolete. In some instances, the connection hardware 30 may include, but is not limited to a male portion that interfaces with a female portion (see, e.g., $E_P$), of the electronic device, E. Although the connection hardware 30 is described to be serviceable (i.e., the connection hardware 30 may be said to be removably-disposed relative to the housing 12 when the gaming device 10 is not in use or being serviced), the connection hardware 30 is fixedly-disposed within a cavity 32 (i.e., the connection hardware 30 is not a component of, for example, a cord that is removably-interfaced with, for example, a port, such as a USB port of the gaming device 10). In some instances, the male portion of the connection hardware 30 may be substantially similar to a male portion end of a "Lighting" cable that may interface with the port, $E_P$, of an electronic device such as, for example, an IPHONE® that is commercially available from APPLE®.

Referring to FIGS. 3A and 3B, the connection hardware 30 is disposed within a cavity 32 of the electronic device port 28 that extends into the housing 12 from the front surface portion $\mathbf{12}_F$ of the housing 12. The cavity 32 may be defined by a length dimension, L, a height dimension, H, and a width dimension, W (see, e.g., FIG. 2). The height dimension, H, and the width dimension, W, are approximately equal to but slightly greater than the height and width dimensions of the electronic device, E, whereas the length dimension, L, may or may not be approximately equal to the length dimension of the electronic device, E. As seen in FIGS. 2 and 3B, the length dimension, L, may be equal to approximately half of a length dimension of the electronic device, E, in order to permit the electronic device, E, to be supportably-disposed within the cavity 32 of the electronic device interface 20 such that the electronic device, E, extends beyond the front surface portion $\mathbf{12}_F$ of the housing 12 and is maintained in a cantilevered orientation with respect to the housing 12. In some instances, the electronic device, E, may include, but is not limited to: a smart phone, a tablet computer, a digital camera or the like.

Upon removably-disposing an end of the electronic device, E, that includes the port, $E_P$, within the cavity 32, the patron may push (see, e.g., arrow, P, in FIG. 3A) the electronic device, E, into the cavity 32 until the connection hardware 30 is disposed within the port, $E_P$, of the electronic device, W (see, e.g., FIG. 3B). Because the width dimension, W, and the height dimension, H, of the cavity 32 are approximately equal to but slightly greater than the width and height dimensions of the electronic device, E, the deliberate sizing of the height dimension, H, and the width dimension, W, results in the port, $E_P$, of the electronic device, E, being aligned with the connection hardware 30 such that the electronic device, E, may be removably-connected to the connection hardware 30; once the electronic device, E, is removably-connected to the connection hardware 30, the electronic device, E, may be said to be selectively and removably hardwire-connected to the electronic device interface 20 that is supported by the gaming device 10.

As a result of the hardwire connection of the electronic device, E, to the electronic device interface 20 that is supported by the gaming device 10, the electronic device, E may be charged by or receive power directly from the power source, AC, due to the power source, AC, being directly connected to the connection hardware 30 of the electronic device interface 20. By definition, the connection hardware 30 of the electronic device port 28 of the electronic device interface 20 may serve as a terminal end or extension of the power source, AC; as a result, any of: (1) the connection hardware 30, (2) the electronic device port 28 and (3) the electronic device interface 20, which is supported by the gaming device 10, may be said to be an extension of the power source, AC, that, therefore, is supported by the gaming device 10. In addition to the power source, AC, providing power to the electronic device, E, if the electronic device, E, includes identification information related to the patron of the gaming device 10 as described above, the selective and removable hardwire-connection of the electronic device, E, to the electronic device interface 20 may result in the electronic device, E, also functioning as a "players club card" in a substantially similar manner as the magnetic strip card, MC.

Figure 4:
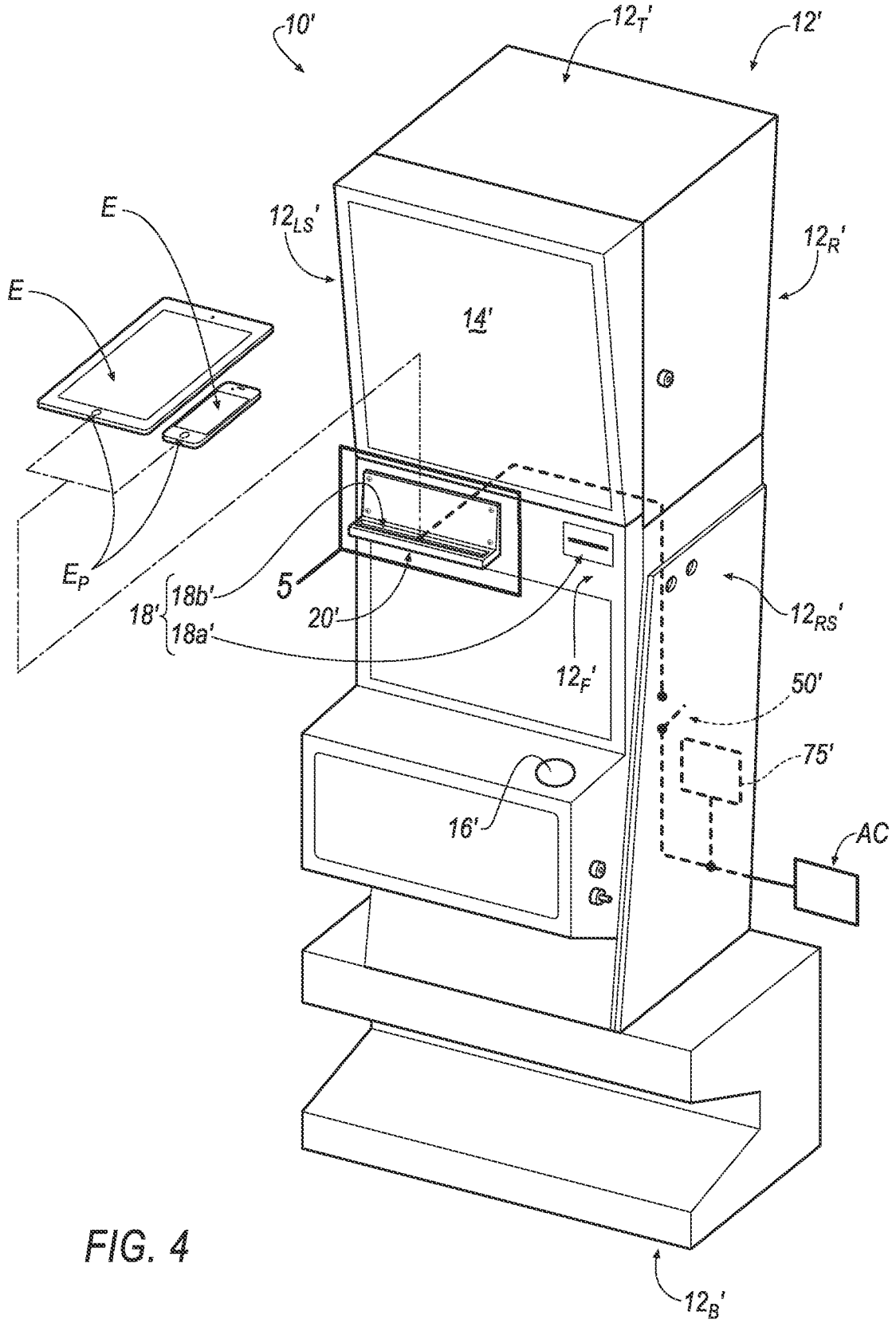
FIG. 4 is a perspective view of an exemplary gaming device.

FIG. 4 illustrates an exemplary implementation of a gaming device, which is shown generally at 10'. The gaming device 10' includes a housing 12' that contains electronics and/or mechanical components that compose a game of chance (noting that the electronics associated with the game of chance is not a computing resource 75', which will be described in greater detail in the following disclosure). The housing 12' may be defined by a plurality of side surface portions such as, for example: a front surface portion $\mathbf{12}_F'$, a rear surface portion $\mathbf{12}_R'$, a top surface portion $\mathbf{12}_T'$, a bottom surface portion $\mathbf{12}_B'$, a left side surface portion $\mathbf{12}_{LS}'$ and a right side surface portion $\mathbf{12}_{RS}'$.

An external power source, AC (e.g., alternating current power) is shown connected to, for example, a computing resource 75' that is disposed within the housing 12' of the gaming device 10'. The computing resource 75' does not contain logic or processing associated with the operation of a game of chance; rather, the computing resource 75' may detect, for example, if one or more of a magnetic strip card, MC, and an electronic device, E, is removably-interfaced with the housing 12'. The computing resource 75' may be, for example, a digital computer, and may include, but is not limited to: one or more electronic digital processors or central processing units (CPUs) in communication with one or more storage resources (e.g., memory, flash memory, dynamic random access memory (DRAM), phase change memory (PCM), and/or disk drives having spindles)).

In some implementations, the front surface portion $12_F'$ of the housing 12' may support a video monitor 14' that displays features (e.g., a plurality of characters and one or more pay-lines) of the game of chance and an actuator 16' that permits authorization of one or more credits to be spent in exchange for at least one play of the game of chance. The front surface portion $12_F'$ of the housing 12' may also define one or more slots 18'.

A slot **18*a*' of the one or more slots 18' permits, for example, the magnetic strip card, MC, to be removably-interfaced with the slot 18*a*'. In some instances, the magnetic strip card, MC, may include identification information related to the patron of the gaming device 10' in order to document and reward the patron in exchange for, for example: (1) a predetermined number or plays on the gaming device 10'**, (2) an amount of wagers by the patron, (3) winnings awarded to the patron, (4) losses incurred by the patron or the like.

A slot **18*b*' of the one or more slots 18' permits, for example, the electronic device, E, to be removably-interfaced with the slot 18*b*'. In some instances, the electronic device, E, may provide a function substantially similar to that as the memory card, MC, as described above and include, for example, identification information related to the patron of the gaming device 10' in order to document and reward the patron in exchange for, for example: (1) a predetermined number or plays on the gaming device 10'**, (2) an amount of wagers by the patron, (3) winnings awarded to the patron, (4) losses incurred by the patron or the like.

Figure 5:
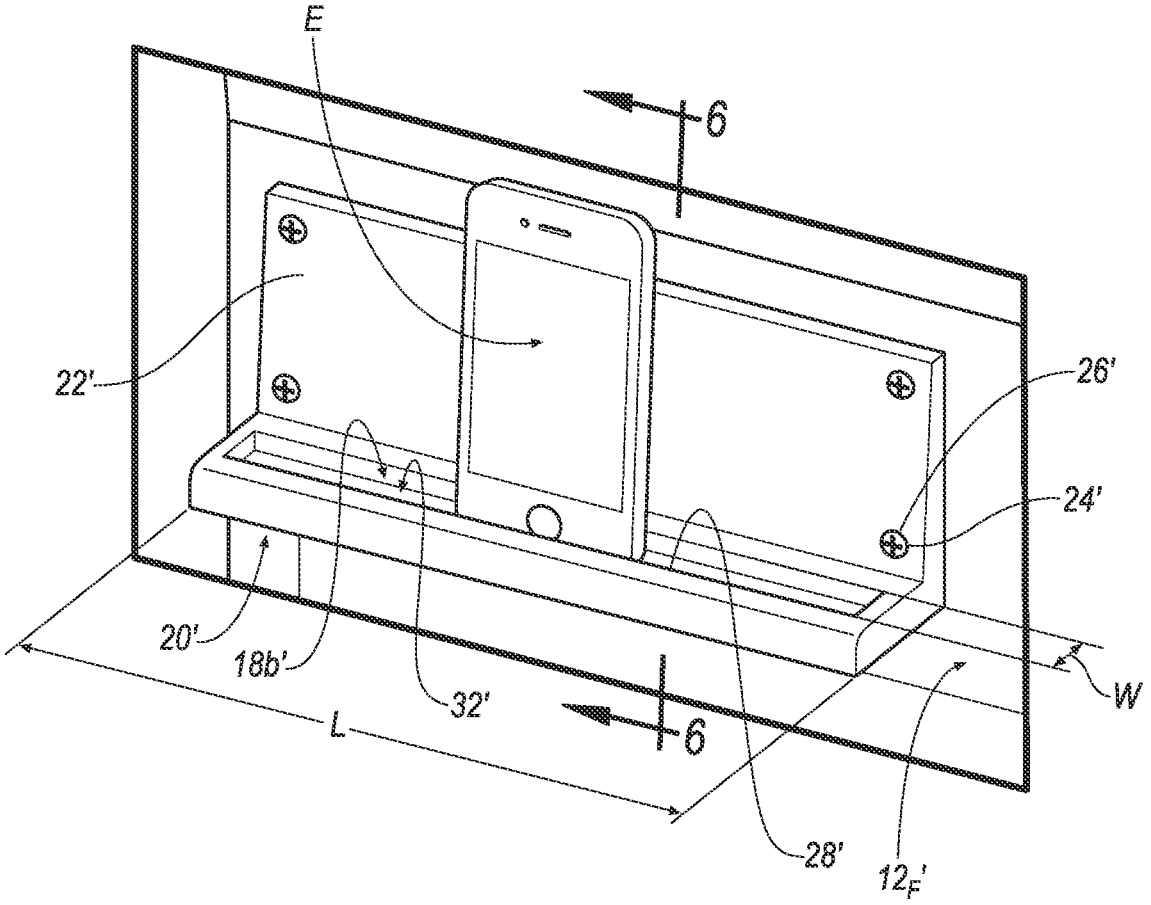
FIG. 5 is an enlarged view of the gaming device of FIG. 4 according to line 5.

Referring to FIGS. 4 and 5, the front surface portion $12_F'$ of the housing 12' may also include an electronic device interface 20'. As seen in FIG. 5, the electronic device interface 20' may include, for example, a faceplate 22' that forms one or more fastener passages 24' and at least the slot **18*b*' of the one or more slots 18'. The electronic device interface 20' may also include one or more fasteners 26' that are disposed within the one or more fastener passages 24' for removably-securing the faceplate 22' to the front surface portion $12_F'$ of the housing 12'**.

Figure 6B:
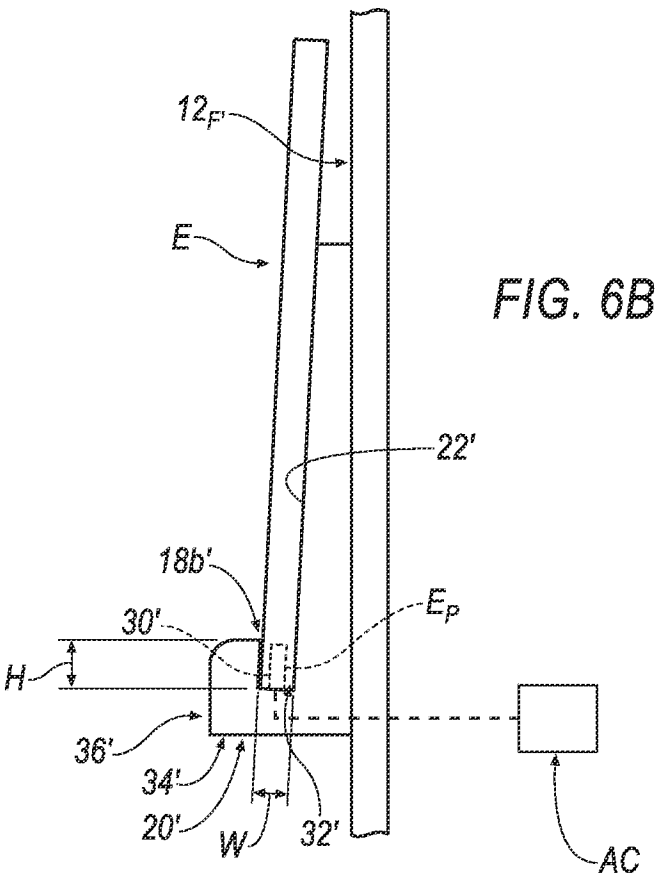
FIG. 6B is a side view referenced from the cross-sectional view of FIG. 6A illustrating an electronic device in a second orientation relative to the gaming device.
Figure 6A:
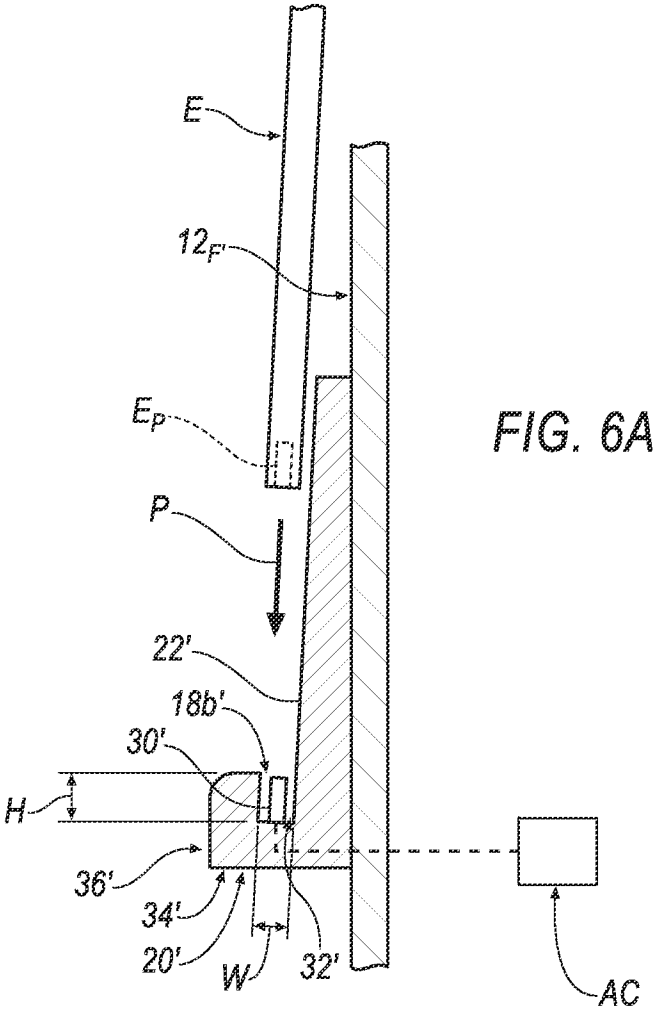
FIG. 6A is a cross-sectional view according to line 6-6 of FIG. 5 illustrating an electronic device in a first orientation relative to the gaming device.

The slot **18*b*' formed by the faceplate 22' may provide access to an electronic device port 28' that includes connection hardware 30' (see FIGS. 6A-6B). The connection hardware 30'** is directly connected to the external power source, AC.

The connection hardware 30' may include any desirable structural configuration. Further, if desired, the one or more fasteners 26' may be removed in order to permit the faceplate 22' to be removed from the front surface portion $12_F'$ of the housing 12' in order to, for example, replace or upgrade the connection hardware 30', if, for example, the connection hardware 30' needs to be serviced, or, for example, is obsolete. In some instances, the connection hardware 30' may include, but is not limited to a male portion that interfaces with a female portion (see, e.g., $E_P$), of the electronic device, E. Although the connection hardware 30' is described to be serviceable (i.e., the connection hardware 30' may be said to be removably-disposed relative to the housing 12' when the gaming device 10' is not in use or being serviced), the connection hardware 30' is fixedly-disposed within a cavity 32' (i.e., the connection hardware 30' is not a component of, for example, a cord that is removably-interfaced with, for example, a port, such as a USB port of the gaming device 10'). In some instances, the male portion of the connection hardware 30' may be substantially similar to a male portion end of a "Lighting" cable that may interface with a port, $E_P$, of an electronic device such as, for example, an IPHONE® that is commercially available from APPLE®.

Referring to FIGS. 5 and 6A-6B, the connection hardware 30' is disposed within a cavity 32' that is accessible by way of the slot **18*b*' formed by the faceplate 22'. The cavity 32' may be defined by a length dimension, L, a width dimension, W, and a height dimension, H, that is selectively sized to accommodate at least partial disposal of the electronic device, E, within the cavity 32'. The electronic device, E, may be associated with the patron of the gaming device 10'**. In some instances, the electronic device, E, may include, but is not limited to: a smart phone, a tablet computer, a digital camera or the like.

Upon removably-disposing (see arrow, P, in FIG. 6A) an end of the electronic device, E, that includes the port, $E_P$, within the cavity 32', the dimensions of the cavity 32' may optionally align and guide the electronic device, E, such that the port, $E_P$, of the electronic device, E, is removably-connected to the connection hardware 30' in a substantially similar manner as described above in FIGS. 2 and 3A-3B. Alternatively, the connection hardware 30' may be visible to the patron, and, as a result, the patron may optionally manually align the port, $E_P$, of the electronic device, E, with the connection hardware 30'. Once the electronic device, E, is removably-connected to the connection hardware 30', the electronic device, E, may be selectively and removably hardwire-connected to the electronic device interface 20' that is supported by the gaming device 10'. As a result, the electronic device, E may be charged by or receive power directly from the power source, AC, due to the power source, AC, being directly connected to the connection hardware 30' of the electronic device interface 20'. By definition, the connection hardware 30' of the electronic device port 28' of the electronic device interface 20' may serve as a terminal end or extension of the power source, AC; as a result, any of: (1) the connection hardware 30', (2) the electronic device port 28' and (3) the electronic device interface 20', which is supported by the gaming device 10', may be said to be an extension of the power source, AC, that, therefore, is supported by the gaming device 10'.

Unlike the exemplary embodiment of the faceplate 22 described above at FIGS. 1-2 and 3A-3B, the faceplate 22' includes a cantilevered portion 34' that extends outwardly and away from the front surface portion $12_F'$ of the housing 12'. As a result, the cantilevered portion 34' at least partially defines the electronic device interface 20' to be a docking tray 36' that supportably-receives the electronic device, E, in a substantially upright orientation (unlike a cantilevered orientation as seen above in FIGS. 2 and 3A-3B).

Figure 7:
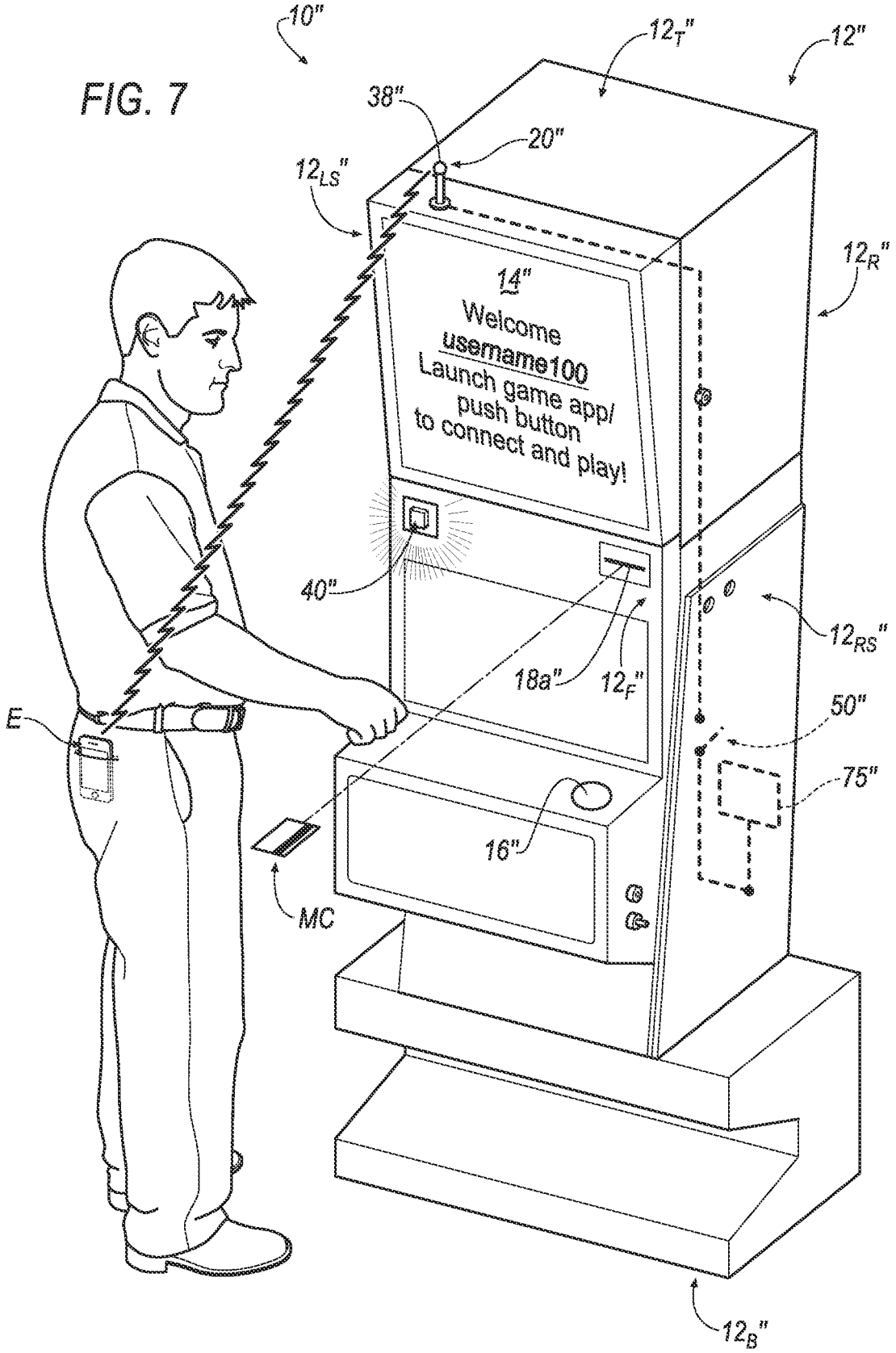
FIG. 7 is a perspective view of an exemplary gaming device.

FIG. 7 illustrates an exemplary implementation of a gaming device, which is shown generally at 10". The gaming device 10" includes a housing 12" that contains electronics and/or mechanical components that compose a game of chance (noting that the electronics associated with the game of chance is not a computing resource 75", which will be described in greater detail in the following disclosure). The housing 12" may be defined by a plurality of side surface portions such as, for example: a front surface portion $12_F''$, a rear surface portion $12_R''$, a top surface portion $12_T''$, a bottom surface portion $12_B''$, a left side surface portion $12_{LS}''$ and a right side surface portion $12_{RS}''$.

An external power source, AC (e.g., alternating current power) is shown connected to, for example, a computing resource 75" that is disposed within the housing 12" of the gaming device 10". The computing resource 75" does not contain logic or processing associated with the operation of a game of chance; rather, the computing resource 75" may detect, for example, if one or more of a magnetic strip card, MC, and an electronic device, E, is removably-interfaced with the housing 12". The computing resource 75" may be, for example, a digital computer, and may include, but is not limited to: one or more electronic digital processors or central processing units (CPUs) in communication with one or more storage resources (e.g., memory, flash memory, dynamic random access memory (DRAM), phase change memory (PCM), and/or disk drives having spindles)).

In some implementations, the front surface portion $\mathbf{12}_F$" of the housing 12" may support a video monitor 14" that displays features (e.g., a plurality of characters and one or more pay-lines) of the game of chance and an actuator 16" that permits authorization of one or more credits to be spent in exchange for at least one play of the game of chance. The front surface portion $\mathbf{12}_F$" of the housing 12" may also define one or more slots 18*a*" that permits, for example, the magnetic strip card, MC, to be removably-interfaced with the slot 18*a*"; in some instances the magnetic strip card, MC, may include identification information related to the patron of the gaming device 10" in order to document and reward the patron in exchange for, for example: (1) a predetermined number or plays on the gaming device 10", (2) an amount of wagers by the patron, (3) winnings awarded to the patron, (4) losses incurred by the patron or the like.

The front surface portion $\mathbf{12}_F$" of the housing 12" may also include an electronic device interface 20". As seen in FIG. 7, the electronic device interface 20" may include, for example, an antenna 38" that permits the computing resource 75" to be wirelessly communicatively-coupled to the electronic device, E. Although the antenna 38" is shown extending from the top surface portion $\mathbf{12}_T$" of the housing 12", the antenna 38" may extend from any surface portion of the housing 12", or, alternatively, the antenna 38" may located within the housing 12" and not arranged upon any surface portion of the housing 12".

The electronic device interface 20" may also include one or more buttons 40" that may be depressed. Depression of the one or more buttons 40" may, for example, result in the computing resource 75" being manually authorized to be wirelessly communicatively-coupled to the electronic device, E.

Unlike the exemplary embodiments described above at FIGS. 1-3B and 4-6B, the gaming device 10" does not include a slot (substantially similar to the slots 18*b*, 18*b*' described above) for supportably-receiving the electronic device, E. Therefore, comparatively, with respect to the structural configuration of the gaming device 10", the electronic device, E, is not disposed within or supported by the housing 12". Rather, the electronic device, E, may be retained by the patron without the electronic device, E, ever being physically interfaced with the gaming device 10". In some instances, the electronic device, E, may include, but is not limited to: a smart phone, a tablet computer, a digital camera or the like.

Figure 8:
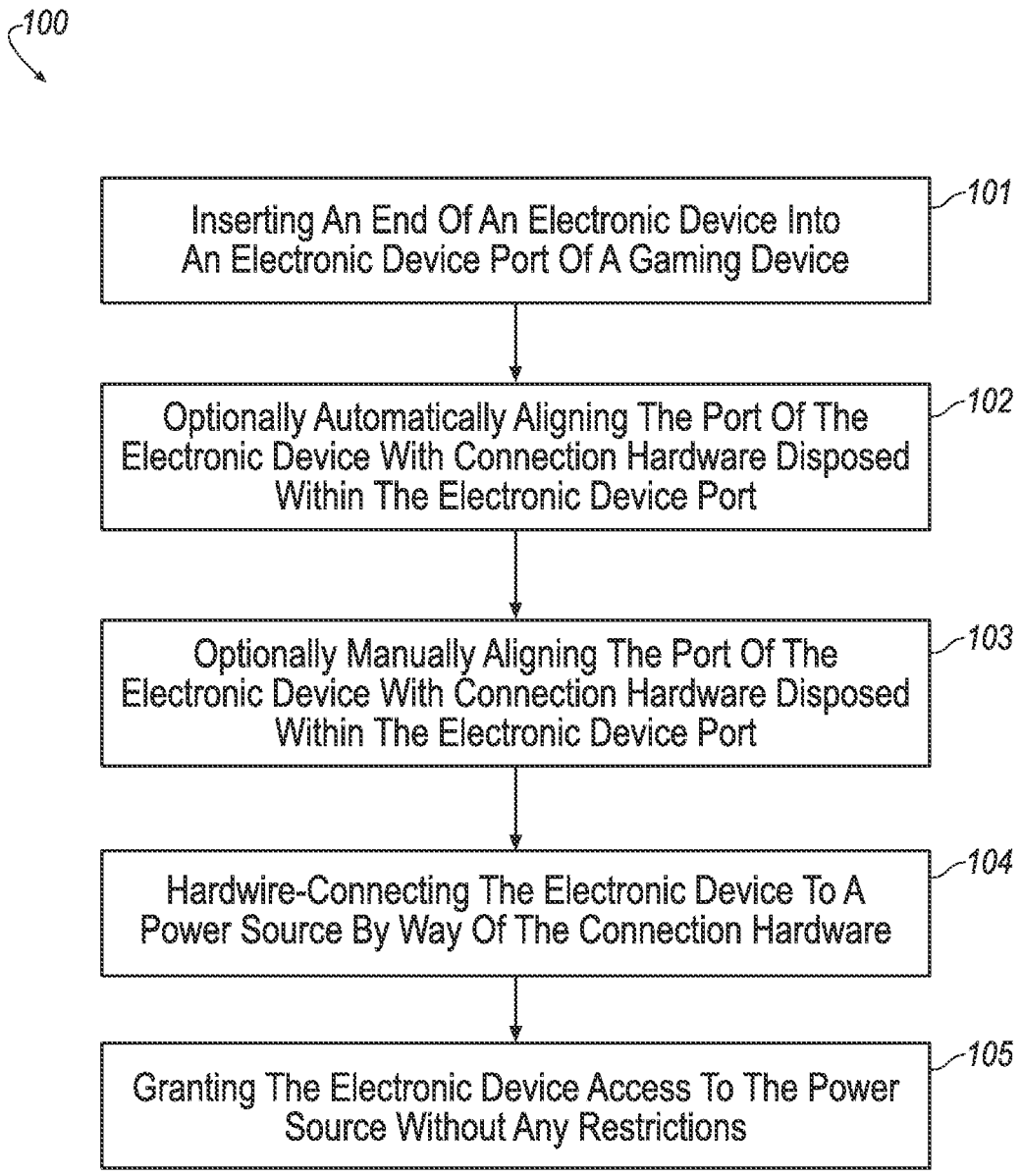
FIG. 8 is a flow diagram of an exemplary methodology associated with either of the gaming device of FIGS. 1-3B and 4-6B.
Figure 9:
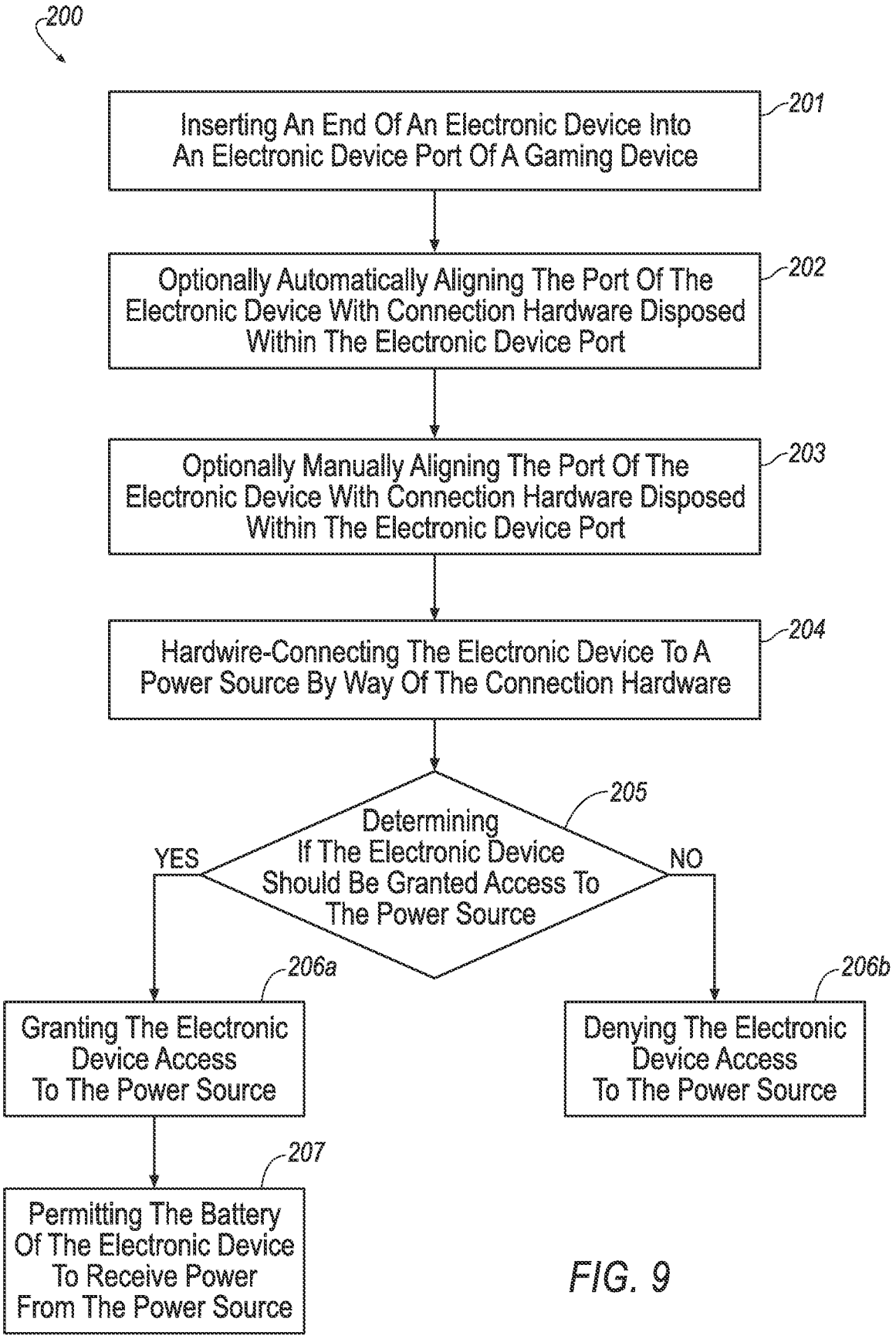
FIG. 9 is a flow diagram of another exemplary methodology associated with either of the gaming device of FIGS. 1-3B and 4-6B.
Figure 10:
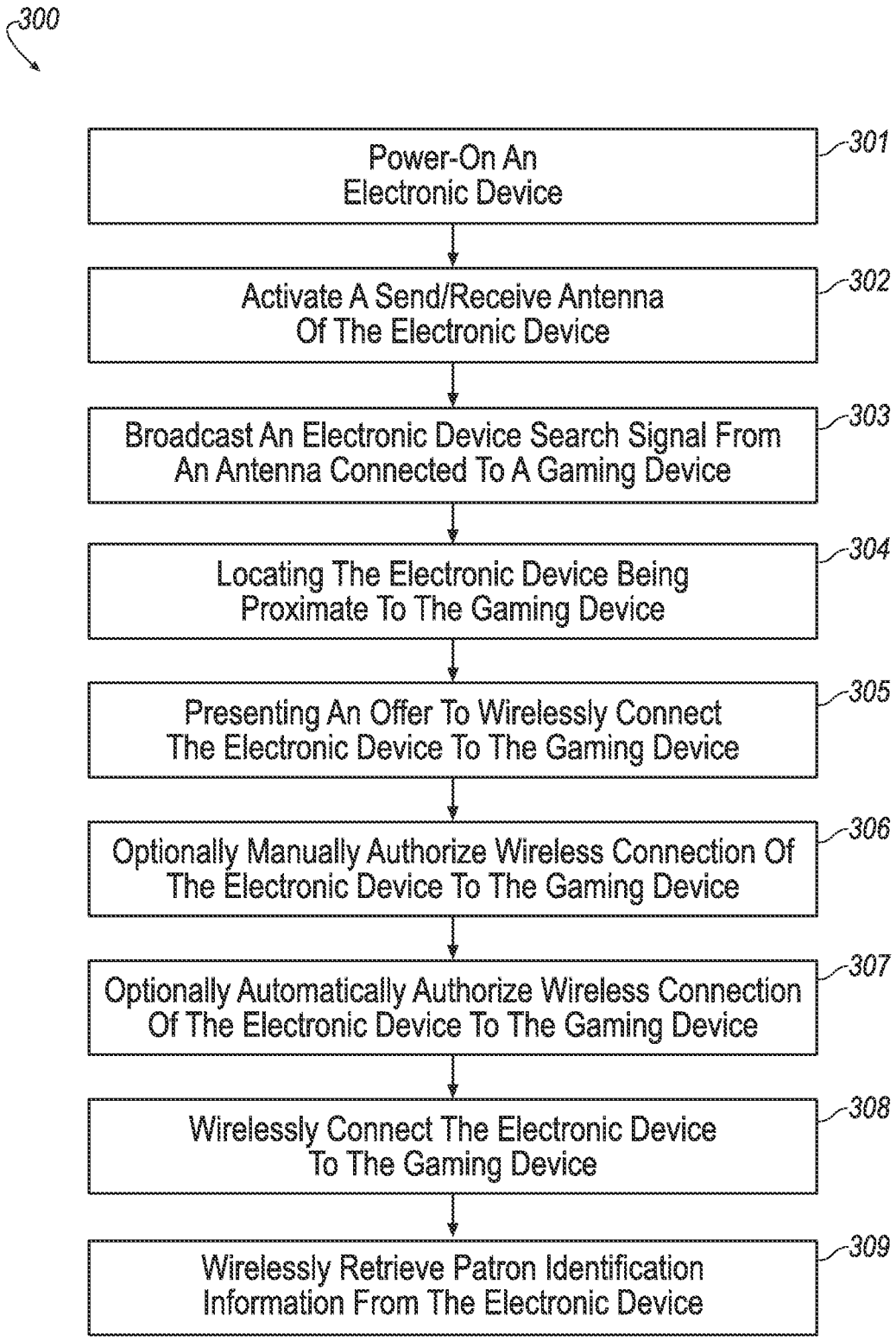
FIG. 10 is a flow diagram of an exemplary methodology associated with the gaming device of FIG. 7.

Referring to FIG. 8, an exemplary method for operating the gaming devices 10, 10' is shown generally at 100. Referring to FIG. 9, another exemplary method for operating the gaming devices 10, 10' is shown generally at 200. Referring to FIG. 10, an exemplary method for operating the gaming device 10" is shown generally at 300.

The method 100 of FIG. 8 permits the gaming device 10, 10' to immediately provide power to the electronic device, E, from the power source, AC, without any restrictions upon selectively-hardwire-interfacing the electronic device, E, with the connection hardware 30, 30'. The method 200 of FIG. 9, however, permits the gaming device 10, 10' to selectively provide power to the electronic device, E, from the power source, AC, upon selectively-hardwire-interfacing the electronic device, E, with the connection hardware 30, 30'.

Referring to FIG. 8, an exemplary methodology 100 for providing power from the power source, AC, to the electronic device, E, is described. Firstly, an end of the electronic device, E, including the port, $E_P$, is selectively disposed 101 within the cavity 32, 32' of the electronic device port 28, 28'. In some instances, as a result of the dimensions, L, W, H, of the cavity 32, 32' being selectively sized to optionally automatically align 102 the port, $E_P$, of the electronic device, E, with the connection hardware 30, 30', the electronic device, E, may be selectively arranged within the cavity 32, 32' to facilitate subsequent hardwire-connection 104 of the electronic device, E, to the connection hardware 30, 30' that is disposed within the cavity 32, 32'. In other instances, the patron may be permitted to view the connection hardware 30, 30' such that the patron may optionally manually align 103 the electronic device, E, with the connection hardware 30, 30' to facilitate subsequent hardwire-connection 104 of the electronic device, E, to the connection hardware 30, 30' that is disposed within the cavity 32, 32'. The battery of the electronic device, E, may then be charged by/receive power from 105 the power source, AC, without any restrictions.

Referring to FIG. 9, an exemplary methodology 200 for providing power from the power source, AC, to the electronic device, E, is described. Firstly, an end of the electronic device, E, including the port, $E_P$, is selectively disposed 201 within the cavity 32, 32' of the electronic device port 28, 28'. Then, as a result of the dimensions, L, W, H, of the cavity 32, 32' being selectively sized to accommodate at least partial disposal of the electronic device, E, within the cavity 32, 32', the electronic device, E, is optionally automatically aligned 202 connection hardware 30, 30' that is disposed within the cavity 32, 32' or optionally manually aligned 203 with connection hardware 30, 30' that is disposed within the cavity 32, 32'. Then, the electronic device, E, may be subsequently hardware-connected 204 to the connection hardware 30, 30' that is disposed within the cavity 32, 32'.

After selectively hardwire-connecting 204 the electronic device, E, to the gaming device 10, 10', a determination is made 205 if the electronic device, E, should be granted access to the power source, AC. The determination 205 may be arbitrated by, for example, programming or logic stored by the computing resource 75, 75' (e.g., the computing resource 75, 75' may be in communication with and open/close a switch 50, 50' (as seen in, e.g., FIGS. 1 and 4) arranged between the connection hardware 30, 30' and the power source, AC). When the switch 50, 50' is closed, access to the power source, AC, is permitted; conversely, when the switch is opened, access to the power source, AC, is denied. If, for example, the determination 205 results in access to the power source, AC, being granted, the methodology 200 may be advanced from step 205 to step 206*a*; alternatively, if, for example, the determination 205 results in access to the power source, AC, being denied, the methodology 200 may be advanced from step 205 to step 206*b*.

Upon the methodology 200 being advanced to step 206*a* where access to the power source, AC, is granted, the battery of the electronic device, E, may then be charged by/receive power from 207 the power source, AC. Conversely, upon the methodology 200 being advanced to step 206*b* where access to the power source, AC, is denied, the battery of the electronic device, E, is not charged by/receive power from the power source, AC.

The determination step 205 may include any desirable condition, prerequisite or qualifying event. For example, the computing resource 75, 75' may determine 205 if the magnetic strip card, MC, is or is not removably-interfaced with the slot 18*a*, 18*a*'. Therefore, if the computing resource 75, 75' determines that the magnetic strip card, MC, is removably-interfaced with the slot 18*a*, 18*a*', the methodology 200 may be advanced from step 205 to step 206*a* where the electronic device, E, is permitted access to the power source, AC; alternatively, if the computing resource 75, 75' determines that the magnetic strip card, MC, has not been removably-interfaced with the slot 18*a*, 18*a*', the methodology 200 may be advanced from step 205 to step 206*b* where the electronic device, E, is denied access to the power source, AC.

In another example, the computing resource 75, 75' may employ a timer to determine 205 if the patron has logged a predetermined amount of play time with the gaming device 10, 10'. Therefore, if the computing resource 75, 75' determines that the patron has met or exceeded the predetermined amount of play time with the gaming device 10, 10', the methodology 200 may be advanced from step 205 to step 206*a* where the electronic device, E, is permitted access to the power source, AC; alternatively, if the computing resource 75, 75' determines that the patron has not met or exceeded the predetermined amount of play time with the gaming device 10, 10', the methodology 200 may be advanced from step 205 to step 206*b* where the electronic device, E, is denied access to the power source, AC.

In yet another example, the computing resource 75, 75' may employ a counter to determine 205 if the patron has wagered or lost a predetermined amount of money with the gaming device 10, 10'. Therefore, if the computing resource 75, 75' determines that the patron has wagered or lost the predetermined amount of money with the gaming device 10, 10', the methodology 200 may be advanced from step 205 to step 206*a* where the electronic device, E, is permitted access to the power source, AC; alternatively, if the computing resource 75, 75' determines that the patron has not wagered or lost the predetermined amount of money with the gaming device 10, 10', the methodology 200 may be advanced from step 205 to step 206*b* where the electronic device, E, is denied access to the power source, AC.

Referring to FIG. 10, an exemplary methodology 300 for wirelessly connecting the electronic device, E, to the gaming device 10" is described. Firstly, a patron may power-on 301 the electronic device, E, and subsequently (or as a default setting) activate 302 a send/receive antenna (not shown) on the electronic device, E. The antenna 38" connected to the computing resource 75" may broadcast an electronic device search signal 303 that searches for one or more electronic devices, E, proximate the gaming device 10". Upon the search signal from the antenna 38" determining 304 that the electronic device, E, is proximate to the gaming device 10" as a result of the search signal broadcast from the antenna 38", the computing resource 75" may present an offer 305 to the patron to wirelessly-connect the electronic device, E, to the computing resource 75" of the gaming device 10" by way of the antenna of the electronic device, E, and the antenna 38" of the computing resource 75".

In an example, the offer 305 may be presented in the form of a message or image displayed upon the video monitor 14" of the gaming device 10", or, alternatively, upon the monitor of the electronic device, E. The patron may optionally manually authorize 306 wireless connection of the electronic device, E, to the computing resource 75" by, for example, depressing the one or more buttons 40" located upon the gaming device 10". Alternatively, the patron may have previously activated an app or software running on the electronic device, E, in order to permit the electronic device, E, to optionally automatically authorize 307 wireless connection of the electronic device, E, to the computing resource 75". In another example, the patron may optionally manually authorize 306 wireless connection of the electronic device, E, to the computing resource 75" by touching or tapping an icon that is displayed upon one or more of the video monitor 14" of the gaming device 10", or, alternatively, the monitor of the electronic device, E.

After the manual or automatic authorization step 306/307 has transpired, the electronic device, E, is wirelessly connected 308 to the computing resource 75" of the gaming device 10" in order to cause the computing resource 75" of the gaming device 10" to wirelessly retrieve 309 patron identification information from the electronic device, E. If, however, the manual or automatic authorization step 306/307 does not occur, a switch 50" (as seen in, e.g., FIG. 7) may remain open, thereby not permitting the computing resource 75" of the gaming device 10" to wirelessly retrieve 309 patron identification information from the electronic device, E.

Wireless connection 308 of the electronic device, E, to the computing resource 75" of the gaming device 10" may result in an expedient connection and recognition of the patron's identification information that is associated with the magnetic strip card, MC (if, for example, the magnetic strip card, MC, is a reward program card, such as, for example, a "players club" card). Association of the patron's identification information by wireless connection 308 may obviate the act of physically inserting the magnetic strip card, MC, into a slot 18*a* of the gaming device 10". As a result of the obviation of the magnetic strip card, MC, associated with the process of retrieving identification information of the patron, costs associated with not only the preparation and maintenance of the magnetic strip card, MC, are eliminated but also the hardware and electronics for receiving and reading information from the magnetic strip card, MC, are also eliminated. In some instances, an app or software stored on the electronic device, E, may include, for example, a digital certificate that includes information related to the patron, which may be substantially similar to information stored upon the magnetic strip of the magnetic strip card, MC; this identification information may be wirelessly obtained 309 by the computing resource 75" in response to the authorization step 306/307 described above.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor and can be implemented in a high-level procedural and/or object-oriented programming language, and/or in assembly/machine language. As used herein, the terms "machine-readable medium" and "computer-readable medium" refer to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

Implementations of the subject matter and the functional operations described in this specification can be implemented in digital electronic circuitry, or in computer software, firmware, or hardware, including the structures disclosed in this specification and their structural equivalents, or in combinations of one or more of them. Moreover, subject matter described in this specification can be implemented as one or more computer program products, i.e., one or more modules of computer program instructions encoded on a computer readable medium for execution by, or to control the operation of, data processing apparatus. The computer readable medium can be a machine-readable storage device, a machine-readable storage substrate, a memory device, a composition of matter affecting a machine-readable propagated signal, or a combination of one or more of them. The terms "data processing apparatus", "computing device" and "computing processor" encompass all apparatus, devices, and machines for processing data, including by way of example a programmable processor, a computer, or multiple processors or computers. The apparatus can include, in addition to hardware, code that creates an execution environment for the computer program in question, e.g., code that constitutes processor firmware, a protocol stack, a database management system, an operating system, or a combination of one or more of them. A propagated signal is an artificially generated signal, e.g., a machine-generated electrical, optical, or electromagnetic signal that is generated to encode information for transmission to suitable receiver apparatus.

A computer program (also known as an application, program, software, software application, script, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for performing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA), a mobile audio player, a Global Positioning System (GPS) receiver, to name just a few. Computer readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

To provide for interaction with a user, one or more aspects of the disclosure can be implemented on a computer having a display device, e.g., a CRT (cathode ray tube), LCD (liquid crystal display) monitor, or touch screen for displaying information to the user and optionally a keyboard and a pointing device, e.g., a mouse or a trackball, by which the user can provide input to the computer. Other kinds of devices can be used to provide interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

One or more aspects of the disclosure can be implemented in a computing system that includes a backend component, e.g., as a data server, or that includes a middleware component, e.g., an application server, or that includes a frontend component, e.g., a client computer having a graphical user interface or a Web browser through which a user can interact with an implementation of the subject matter described in this specification, or any combination of one or more such backend, middleware, or frontend components. The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

The computing system can include clients and servers. A client and server are generally remote from each other and typically interact through a communication network. The relationship of client and server arises by virtue of computer programs running on the respective computers and having a client-server relationship to each other. In some implementations, a server transmits data (e.g., an HTML page) to a client device (e.g., for purposes of displaying data to and receiving user input from a user interacting with the client device). Data generated at the client device (e.g., a result of the user interaction) can be received from the client device at the server.

While this specification contains many specifics, these should not be construed as limitations on the scope of the disclosure or of what may be claimed, but rather as descriptions of features specific to particular implementations of the disclosure. Certain features that are described in this specification in the context of separate implementations can also be implemented in combination in a single implementation. Conversely, various features that are described in the context of a single implementation can also be implemented in multiple implementations separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multi-tasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

The present invention has been described with reference to certain exemplary embodiments thereof. However, it will be readily apparent to those skilled in the art that it is possible to embody the invention in specific forms other than those of the exemplary embodiments described above. This may be done without departing from the spirit of the invention. The exemplary embodiments are merely illustrative and should not be considered restrictive in any way. The scope of the invention is defined by the appended claims and their equivalents, rather than by the preceding description.

What is claimed is:

1. A method, comprising:

providing an electronic device having a battery and a display, powering-on the electronic device using the battery;

activating a send/receive antenna of the electronic device;

broadcasting an electronic device search signal from an antenna connected to a gaming device;

locating the electronic device being proximate to the gaming device;

transmitting an offer from the gaming device to the electronic device;

presenting the offer for acceptance on the display of the electronic device;

upon acceptance of the offer on the electronic device, wirelessly connecting the electronic device to the gaming device;

wirelessly retrieving patron identification information from the electronic device;

permitting power to be provided from the gaming device to the electronic device to charge the battery of the electronic device based on occurrence of a qualifying event, the qualifying event being at least one of (i) a patron associated with the patron identification information logging a predetermined amount of play time, or (ii) the patron wagering a predetermined amount of money with the gaming device.

2. A method of operating a gaming device, the method comprising:

wirelessly receiving, at the gaming device, a send/receive signal from an electronic device having a battery and a display;

wirelessly broadcasting, from the gaming device, an electronic device search signal;

identifying, by the gaming device, that the electronic device is proximate to the gaming device;

wirelessly receiving, at the gaming device, an authorization from the electronic device to connect to the electronic device, whereby the authorization is initially provided to the electronic device by a user via the display;

upon receipt of the authorization from the electronic device, wirelessly connecting the gaming device to the electronic device;

determining, via the gaming device, whether a qualifying event has occurred, the qualifying event being at least one of (i) a patron associated with the patron identification information logging a predetermined amount of play time, or (ii) the patron wagering a predetermined amount of money with the gaming device; and when the qualifying event has occurred, transmitting, from the gaming device, power to the electronic device to charge the battery of the electronic device.

3. The method of claim 2, further comprising wirelessly retrieving patron identification information from the electronic device.

* * * * *